US010274261B2

(12) United States Patent
Wei et al.

(10) Patent No.: US 10,274,261 B2
(45) Date of Patent: Apr. 30, 2019

(54) HEAT EXCHANGING BOARD AND BOARD-TYPE HEAT EXCHANGER PROVIDED WITH HEAT EXCHANGING BOARD

(71) Applicant: Danfoss Micro Channel Heat Exchanger (Jiaxing) Co., Ltd., Zhejiang (CN)

(72) Inventors: Wenjian Wei, Zhejiang (CN); Zhifeng Zhang, Zhejiang (CN); Iztok Golobic, Mirna Pec (SI)

(73) Assignee: Danfoss Micro Channel Heat Exchanger (Jiaxing) Co., Ltd, Zhejiang (CN)

( * ) Notice: Subject to any disclaimer, the term of this patent is extended or adjusted under 35 U.S.C. 154(b) by 335 days.

(21) Appl. No.: 15/114,883

(22) PCT Filed: Jan. 14, 2015

(86) PCT No.: PCT/CN2015/070667
§ 371 (c)(1),
(2) Date: Jul. 28, 2016

(87) PCT Pub. No.: WO2015/113468
PCT Pub. Date: Aug. 6, 2015

(65) Prior Publication Data

US 2016/0341484 A1 Nov. 24, 2016

(30) Foreign Application Priority Data

Jan. 29, 2014 (CN) ..... 2014 1 0043032

(51) Int. Cl.
*F28D 9/00* (2006.01)
*F28F 3/04* (2006.01)

(52) U.S. Cl.
CPC ..... *F28D 9/005* (2013.01); *F28F 3/042* (2013.01)

(58) Field of Classification Search
CPC . F28D 9/005; F28F 3/042; F28F 3/025; F28F 3/02; B01F 5/0617
See application file for complete search history.

(56) References Cited

U.S. PATENT DOCUMENTS 1,376,882 A * 5/1921 Hromadko ..... F28D 1/0316 165/153
3,217,845 A * 11/1965 Koeller ..... B21D 13/10 428/118

(Continued)

FOREIGN PATENT DOCUMENTS

CN 1815123A A 8/2006
CN 1884957 A 12/2006

(Continued)

OTHER PUBLICATIONS

Supplemental European Search Report for Serial No. EP 15 74 3601 dated Oct. 11, 2017.

(Continued)

*Primary Examiner* — Tho V Duong
(74) *Attorney, Agent, or Firm* — McCormick, Paulding & Huber LLP

(57) ABSTRACT

A heat exchanging board (1) and a board-type heat exchanger provided with the heat exchanging board (1). The heat exchanging board (1) comprises a board main body (11). Multiple recessed portions (12) and multiple raised portions (13) are disposed on the surface of the board main body (11). The multiple recessed portions (12) and the multiple raised portions (13) are disposed in a staggered manner along a first direction (S1) and are disposed in a staggered manner along a second direction (S2) perpendicular to the first direction (S1). Top portions of the multiple (Continued)

raised portions (13) are provided slender forms along the first direction (S1). The heat exchanging board (1) and the board-type heat exchanger provided with the heat exchanging board (1) can ensure good strength of the heat exchanger in the case of ensuring the heat exchanging efficiency, and can reduce manufacturing cost of the heat exchanging board (1).

12 Claims, 10 Drawing Sheets

(56) References Cited

U.S. PATENT DOCUMENTS 4,249,597 A * 2/1981 Carey ..... F28D 9/005 165/166
4,431,537 A * 2/1984 Hirota ..... C02F 3/082 210/150
4,915,165 A * 4/1990 Dahlgren ..... F28F 3/046 165/166
5,398,751 A 3/1995 Blomgren
5,487,424 A * 1/1996 Davison ..... F28D 9/0037 165/166
6,016,865 A * 1/2000 Blomgren ..... F28D 9/0043 165/148
6,047,769 A * 4/2000 Shimoya ..... F28D 1/0333 165/148
6,648,067 B1 * 11/2003 Maute ..... D06F 58/24 165/166
6,899,163 B2 * 5/2005 Finch ..... F28F 3/083 165/166
6,938,685 B2 * 9/2005 Duerr ..... F28D 1/0333 165/148
2013/0199152 A1 * 8/2013 Menheere ..... F02C 7/10 60/39.511

FOREIGN PATENT DOCUMENTS

CN 101493293 A 7/2009
CN 102564176 A 7/2012
CN 202432896 U 9/2012
EP 2455695 A2 5/2012
JP 2002-81881 A 3/2002
JP 2005-326074 A 11/2005
JP 2008116138 A 5/2008
JP 2012112645 A 6/2012

OTHER PUBLICATIONS

International Search Report for PCT Serial No. PCT/CN2015/070667 dated Mar. 23, 2015.

* cited by examiner

HEAT EXCHANGING BOARD AND BOARD-TYPE HEAT EXCHANGER PROVIDED WITH HEAT EXCHANGING BOARD

CROSS-REFERENCE TO RELATED APPLICATION

This application is entitled to the benefit of and incorporates by reference subject matter disclosed in the International Patent Application No. PCT/CN2015/070667 filed on Jan. 14, 2015 and Chinese Patent Application 201410043032.X filed Jan. 29, 2014.

TECHNICAL FIELD

The present invention relates to the field of heat exchangers. In particular, the present invention relates to a heat exchange plate and a plate-type heat exchanger having the heat exchange plate.

BACKGROUND ART

In recent years, plate-type heat exchangers have been widely used in equipment such as air conditioners, refrigerators, water chillers and heat pumps. Generally, a plate-type heat exchanger comprises multiple heat exchange plates which are joined together by brazing, full welding, semi-welding etc. or in a dismantlable manner, with the spaces between the plates forming channels for the circulation of heat exchange fluid. When the heat exchange fluid flows through the channels, it contacts the heat exchange plates, and thereby achieves heat exchange.

FIG. 1(*a*) shows a type of heat exchange plate having an inverted-V-shaped pattern. As the figure shows, the heat exchange plate has a plate main body, with a concave-convex inverted-V-shaped pattern provided over the entire surface of the plate main body. Such a heat exchange plate can provide good distribution of fluid over the entire plate main body surface, and so can achieve high heat exchange efficiency. However, when such heat exchange plates are installed for example by brazing, full welding or semi-welding etc. or in a dismantlable manner, the inverted-V-shaped patterns of adjacent heat exchange plates are installed in opposite directions, i.e. a corresponding set of inverted-V-shaped patterns on two adjacent heat exchange plates only has two installation contact points when installed, and consequently, the strength of the entire plate-type heat exchanger is not high. Moreover, such heat exchange plates must not be too thin, otherwise the problem of strength not meeting requirements will likewise arise, resulting in a drop in the reliability of the entire plate-type heat exchanger.

FIG. 1(*b*) shows another type of common heat exchange plate having a "dimple" pattern. As the figure shows, the heat exchange plate has a plate main body, with multiple protrusions and recesses provided over the entire surface of the plate main body, wherein the multiple protrusions and recesses are spaced apart from one another. When a plurality of such heat exchange plates are installed, multiple protrusions on adjacent heat exchange plates are in contact with one another. Thus, compared with heat exchange plates having an inverted-V-shaped pattern, the transitional curved surface between protrusion and recess is more rational, and the distribution of installation contact points is also more rational, so that the entire plate-type heat exchanger has better strength. Moreover, the thickness of the heat exchange plate may be correspondingly reduced, so as to achieve the object of saving costs. However, the fluid distribution of this heat exchange plate is poorer than that of the heat exchange plate having an inverted-V-shaped pattern described above, so the heat exchange efficiency is affected.

Thus, there exists a need with regard to plate-type heat exchangers obtained by fitting together heat exchange plates; specifically, it is desired that the heat exchanger joining strength can be guaranteed and the cost of manufacturing the heat exchange plates can be reduced while ensuring good heat exchange efficiency, so as to reduce the cost of manufacturing plate-type heat exchangers.

SUMMARY

Thus, the present invention provides a heat exchange plate which is capable of having good heat exchange efficiency and at the same time can provide a more rational distribution of installation contact points. Thus, when multiple heat exchange plates are fitted together, a plate-type heat exchanger of reliable strength can be realized, and the heat exchange plates can be made thinner, so that the cost of manufacturing the heat exchange plates can be reduced.

According to the present invention, the heat exchange plate is provided, comprising a plate main body, with multiple recesses and protrusions being disposed on a surface of the plate main body, wherein the multiple recesses and protrusions are arranged alternately in a first direction and also arranged alternately in a second direction perpendicular to the first direction, and the tops of the multiple protrusions have an elongated shape in the first direction.

With such a structural arrangement, when a heat exchange fluid flows past the plate main body in a longitudinal direction, longitudinal bypass is reduced, so that transverse distribution is enhanced, which is more conducive to transverse flow. Moreover, the elongated shape of the protrusions is more conducive to the generation of vortices. Thus the heat exchange efficiency is increased. In addition, due to the elongated shape of the protrusions, when multiple heat exchange plates are installed by brazing, semi-welding or full welding etc. or in a dismantlable manner, the installation contact area is increased, and a transitional curved surface between protrusion and recess is more conducive to distribution of stress, so that it is possible to ensure that the heat exchanger has good strength, and the thickness of the heat exchange plates can be correspondingly reduced, to achieve a reduction in cost.

In one embodiment, a protrusion and a recess which are adjacent to one another are connected in a transitional manner by means of an inclined surface therebetween, while adjacent recesses are connected in a transitional manner by means of a curved surface trough therebetween, the bottom of the curved surface trough being higher than the bottom of the recess.

In one embodiment, an apex angle of a triangle formed by three recesses or protrusions which are adjacent in the direction of elongation of the protrusions is in the range 50° to 160°. The inventors have found that such an arrangement can further improve fluid distribution and is conducive to the generation of vortices, and thereby increases the heat exchange efficiency.

Preferably, the apex angle is in the range 70° to 150°.

In one embodiment, each protrusion has a first edge and a second edge, the first edge and/or the second edge being in the shape of a curved line or a straight line.

In one embodiment, each protrusion has a third edge and a fourth edge; the angular range of an included angle between the third edge and the fourth edge is 0° to 180°.

In one embodiment, the shape of the top of the protrusions is , , , , , or .

Preferably, the angular range of the included angle is 20° to 110°.

In a preferred embodiment, both the first edge and the second edge are arcuate, and the curvature of the first edge is greater than the curvature of the second edge.

In another preferred embodiment, the first edge is in the shape of a straight line, while the second edge is arcuate.

In one embodiment, the bottoms of the multiple recesses have a round shape or a polygonal shape.

In one embodiment, the first direction makes an acute angle with a longitudinal direction, makes an obtuse angle with the longitudinal direction, is parallel to the longitudinal direction or is perpendicular to the longitudinal direction.

In another embodiment, the heat exchange plate comprises at least two heat exchange plate units, wherein the orientation of the first directions in any two adjacent exchange plate units forms an inverted-V shape.

The present invention also provides a heat exchanger, comprising multiple heat exchange plates as described above, joined together in an overlapping state, with channels for the flow of heat exchange fluid being formed in spaces between the plates. In one embodiment, the multiple heat exchange plates are joined together by brazing, semi-welding or full welding. In one embodiment, the multiple heat exchange plates are joined together in a dismantlable manner.

BRIEF DESCRIPTION OF THE DRAWINGS

The present invention will be described in detail below with reference to the accompanying drawings attached, wherein identical labels in the drawings indicate identical structures or components. In the drawings.

DETAILED DESCRIPTION

Figure 1:
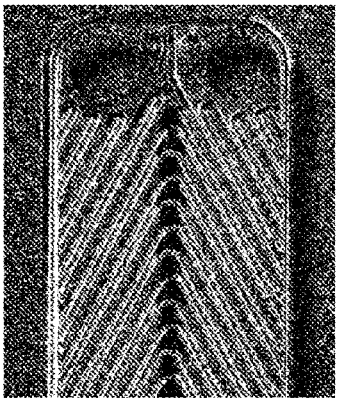
FIGS. 1(*a*) and (*b*) show two plate-type heat exchange plates in the prior art.
Figure 1:
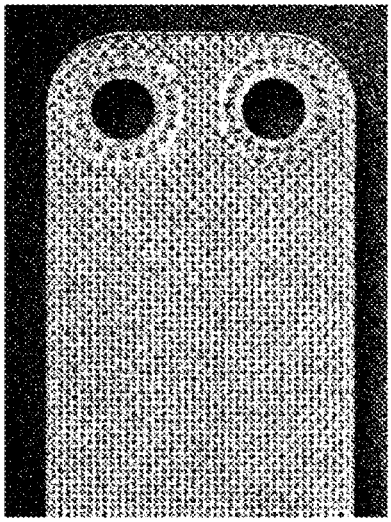
Figure 2A:
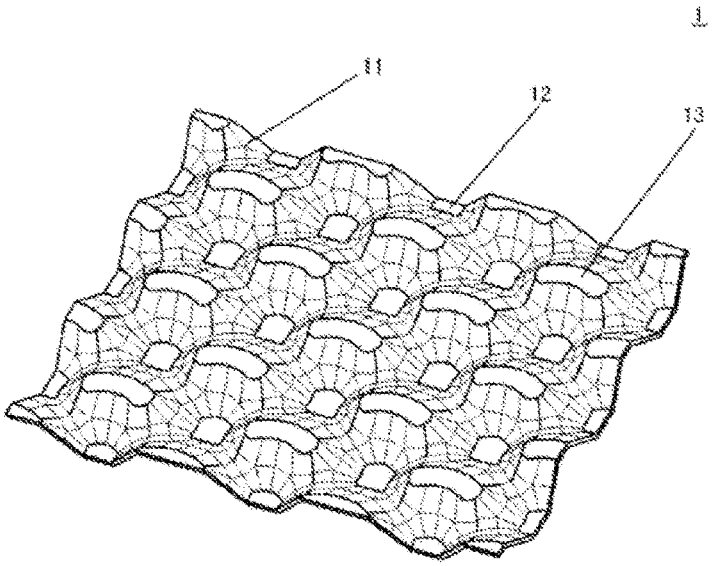
FIGS. 2(*a*) and (*b*) show perspective views of a part of a heat exchange plate according to an embodiment of the present invention, wherein multiple protrusions and recesses are provided on a surface of the plate main body.
Figure 2B:
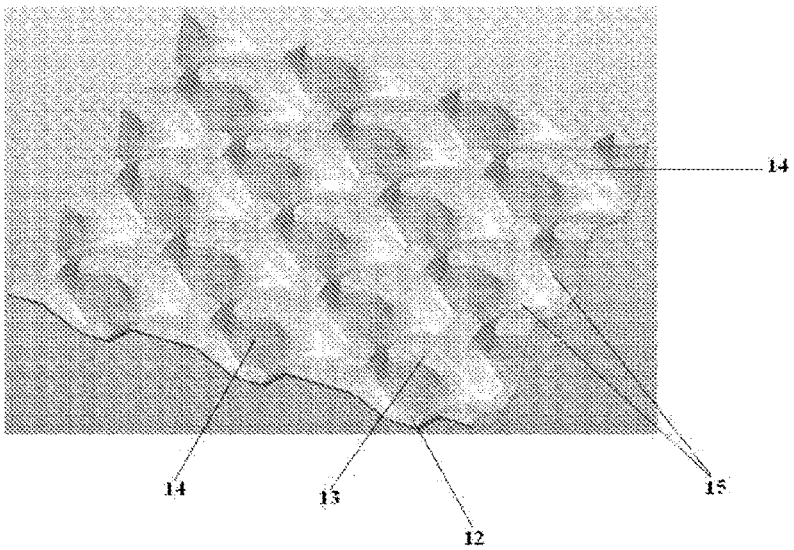

FIGS. 2(*a*) and (*b*) show perspective views of a part of a heat exchange plate according to an exemplary embodiment of the present invention. FIGS. 3-9 show ways of arranging recesses and protrusions on the surface of a plate main body of a heat exchange plate according to various embodiments of the present invention, respectively. As the figures show, a heat exchange plate 1 according to the present invention comprises a plate main body 11, with multiple recesses 12 and protrusions 13 being disposed on a surface of the plate main body 11, wherein the multiple recesses 12 and protrusions 13 are arranged alternately in a first direction S1 and also arranged alternately in a second direction S2 perpendicular to the first direction, and the tops of the multiple protrusions 13 have an elongated shape in the first direction S1.

With such a structural arrangement, when a heat exchange fluid flows past the plate main body in a longitudinal direction L, longitudinal bypass is reduced, so that transverse distribution is enhanced, which is more conducive to transverse flow. Moreover, the elongated shape of the protrusions is more conducive to the generation of vortices. Thus the heat exchange efficiency is increased. In addition, due to the elongated shape of the protrusions, when multiple heat exchange plates are installed by brazing, semi-welding or full welding etc. or in a dismantlable manner, the installation contact area is increased, and a transitional curved surface between protrusion and recess is more conducive to distribution of stress, so that it is possible to ensure that the heat exchanger has good strength, and the thickness of the heat exchange plates can be correspondingly reduced, to achieve a reduction in cost.

It should be understood that the present invention is not limited to applications in which the heat exchange fluid flows past the plate main body in a longitudinal direction. The heat exchange fluid could also flow past the plate main body in a transverse or oblique direction. When the heat exchange fluid flows past the plate main body in a transverse or oblique direction, the heat exchange efficiency can still be increased, even though the positions of the vortices change.

In addition, it should be pointed out that although the multiple recesses 12 and protrusions 13 are arranged alternately in the first direction S1 and the second direction S2, the multiple recesses 12 and protrusions 13 need not necessarily be arranged alternately in a straight line in the first direction S1 or the second direction S2. In other words, the recesses 12 and protrusions 13 arranged alternately in the first direction S1 may have their positions staggered in the second direction S2, and the recesses 12 and protrusions 13 arranged alternately in the second direction S2 may have their positions staggered in the first direction S1, as shown by way of example in FIG. 9 for instance.

In one embodiment, a protrusion 13 and a recess 12 which are adjacent to one another are connected in a transitional manner by means of an inclined surface 14 therebetween, while adjacent recesses 12 are connected in a transitional manner by means of a curved surface trough 15 therebetween, the bottom of the curved surface trough 15 being higher than the bottom of the recess 12. The inventors have found that such a structural arrangement can enhance the abovementioned fluid distribution effect.

Figure 3:
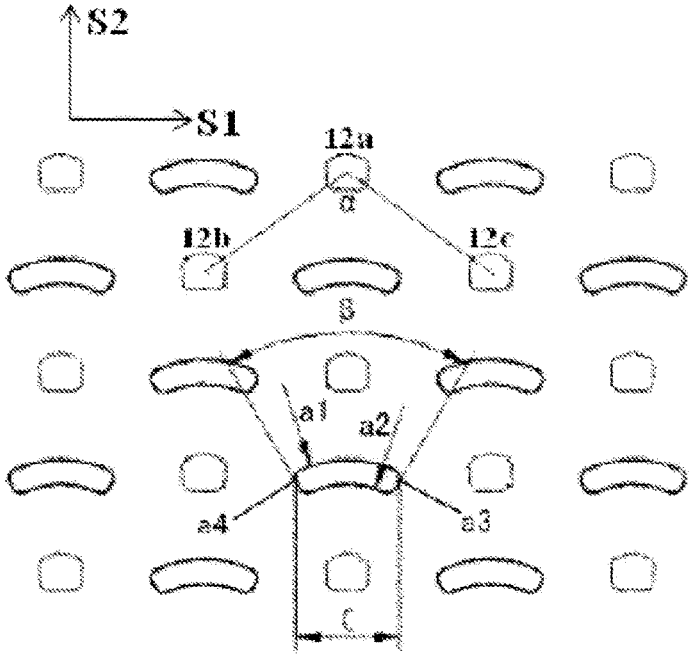
FIGS. 3-9 show various ways of arranging recesses and protrusions on the surface of a plate main body of a heat exchange plate according to various embodiments of the present invention, respectively.

In one embodiment, e.g. as shown by way of example in FIG. 3, an apex angle $\alpha$ of a triangle formed by three recesses 12*a*, 12*b* and 12*c* which are adjacent in the first direction S1 is in the range 50° to 160°. Preferably, the apex angle $\alpha$ is in the range 70° to 150°. The inventors have found that such an arrangement is more conductive to vortex generation and distribution, and so can further increase the heat exchange efficiency.

Figure 4:
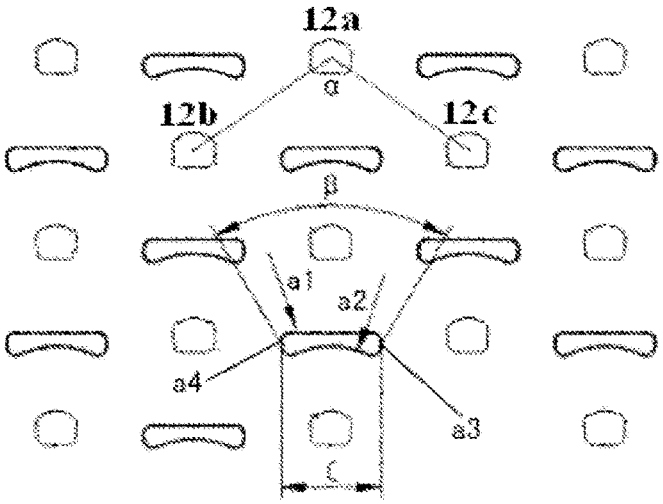
Figure 5:
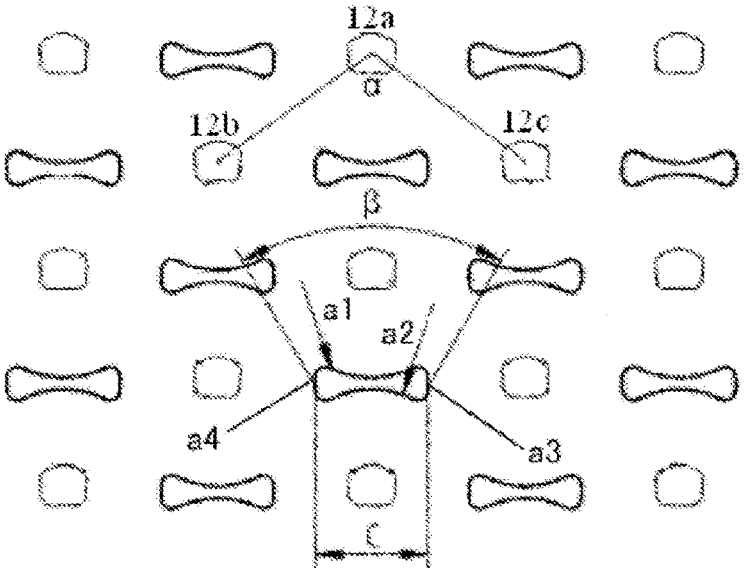
Figure 6:
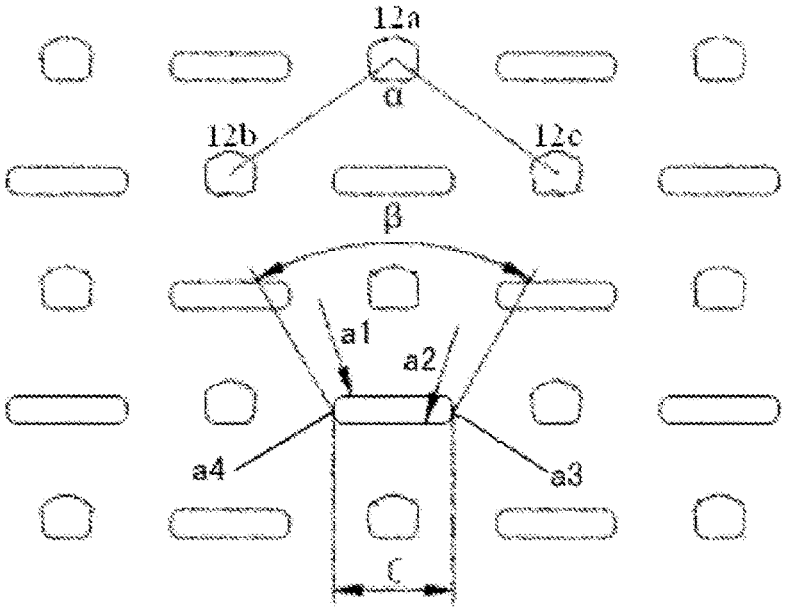
Figure 7:
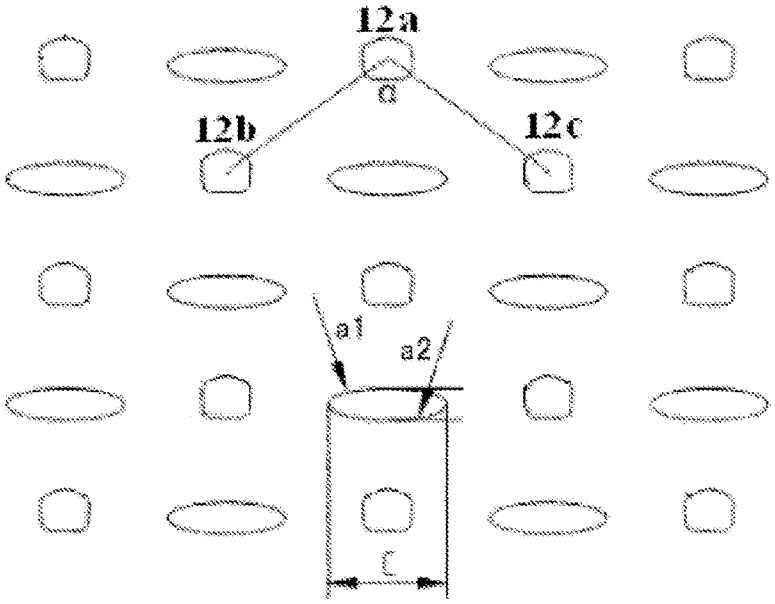
Figure 8:
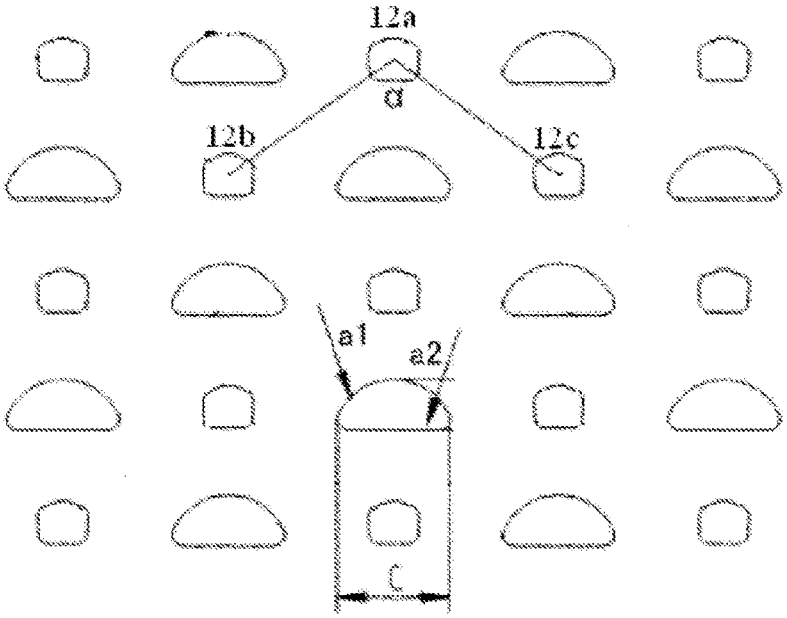
Figure 9:
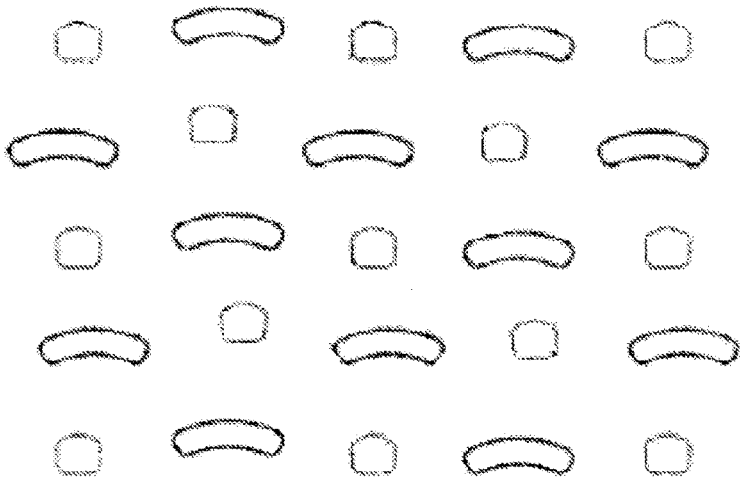
Figure 10A:
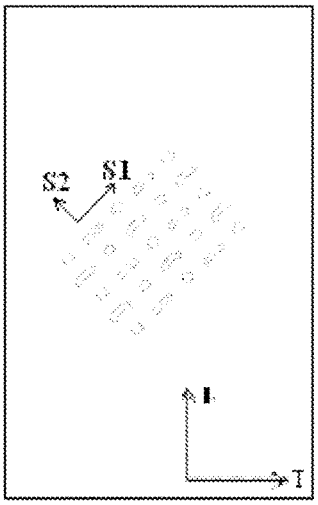
FIGS. 10*a*-10*d* show exemplary arrangements of heat exchange plates according to embodiments of the present invention, wherein the orientation of the first direction makes an acute angle with the longitudinal direction, makes an obtuse angle with the longitudinal direction, forms an inverted-V-shape, or is parallel to the longitudinal direction, respectively.
Figure 10B:
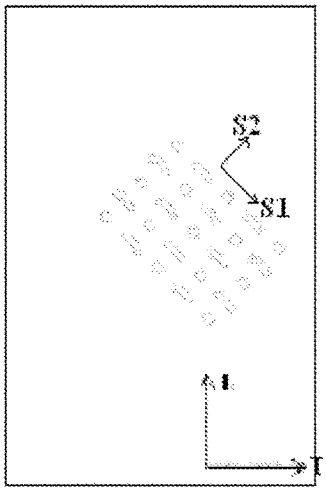
Figure 10C:
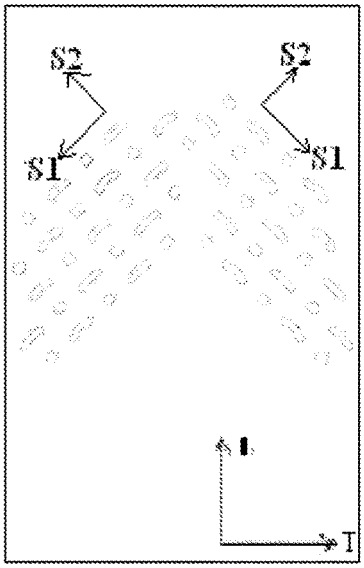
Figure 10D:
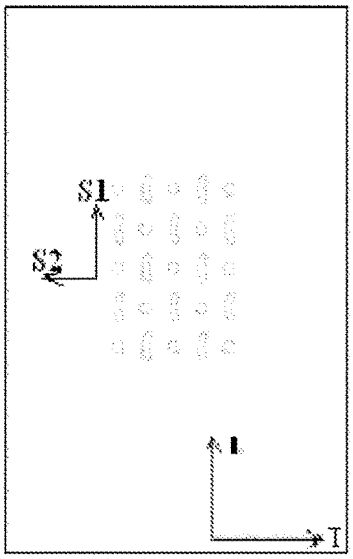

In one embodiment, each protrusion 13 has a first edge a1 and a second edge a2, wherein the first edge a1 and/or the second edge a2 may be in the shape of a curved line or a straight line. For instance, as FIG. 3 shows, both the first edge a1 and the second edge a2 are arcuate, and the curvature of the first edge a1 is greater than the curvature of the second edge a2. For instance, as FIG. 4 shows, the first edge a1 is in the shape of a straight line, while the second edge a2 is arcuate. Of course, those skilled in the art will understand that the term "arcuate" used herein includes substantially arcuate shapes formed by connecting a number of arc sections with different curvatures but the same bending direction, in which case "curvature" means the approximate average curvature.

FIGS. 3-8 show (not exhaustively) show some shapes which may be used for the shape of the top of the protrusions, e.g. , , , , or . It can be understood that compared with the case where the second edge a2 is in the shape of a straight line, stronger vortices can be provided when the second edge a2 is arcuate.

In one embodiment, each protrusion 13 may have a third edge a3 and a fourth edge a3; the angular range of an included angle β between the third edge a3 and the fourth edge a4 is 0° to 180°. For example, as FIG. 3 shows, a3 and a4 are connected to the first edge a1 and the second edge a2 by an arcuate transition, to form an elongated structure of the top of the protrusion 13, wherein the third edge a3 and the fourth edge a4 form an included angle β, the range of the included angle β being 0° to 180°. In a preferred embodiment, the angular range of the included angle β is 20° to 110°.

In one embodiment, the bottom of the recess 12 has a round shape or a polygonal shape.

It can be understood that the longitudinal length C of the protrusion 13 can be adjusted according to actual requirements.

FIGS. 10*a*-10*d* show exemplary arrangements of heat exchange plates according to embodiments of the present invention. In the examples shown in FIGS. 3-9 above, the first direction S1 and the second direction S2 are parallel to a transverse direction T and a longitudinal direction L respectively, but as shown in FIGS. 10*a*-10*d* for example, the recesses 12 and protrusions 13 may be arranged obliquely on the plate main body 11, wherein the orientation of the first direction S1 makes an acute angle with the longitudinal direction L, makes an obtuse angle with the longitudinal direction L, forms an inverted-V-shape, or is parallel to the longitudinal direction L, respectively.

Figure 11:
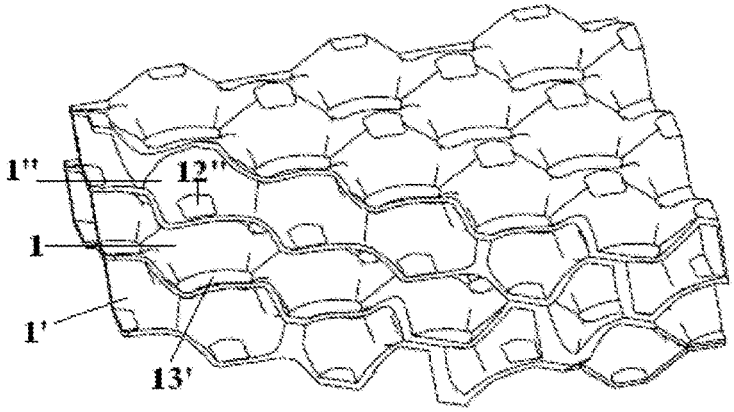
FIG. 11 shows a schematic installation diagram of heat exchange plates according to the present invention.

During use, first of all multiple heat exchange plates according to an embodiment of the present invention are joined together by brazing, full welding or semi-welding etc. or in a dismantlable manner, and channels for the flow of heat exchange fluid are formed in spaces between the plates, so as to form a plate-type heat exchanger according to the present invention. Based on the structure of the heat exchange plate 1 of the present invention, during installation, one side of a heat exchange plate 1 is installed with protrusions 13 in contact with protrusions 13' of an adjacent heat exchange plate 1', while the other side is installed with recesses 12 in contact with recesses 12" of another adjacent heat exchange plate 1", as shown in FIG. 11. Thus, two different fluid distribution modes are substantially formed on two sides of the same heat exchange plate; on that side which is installed with protrusions in contact with one another, the fluid filling amount is less. Such asymmetric fluid distribution modes enable better fluid adjustment and performance adjustment modes to be provided. Moreover, since the pressure drop is lower on that side which is installed with recesses in contact with one another, the power consumption of the system can be reduced.

Figure 12:
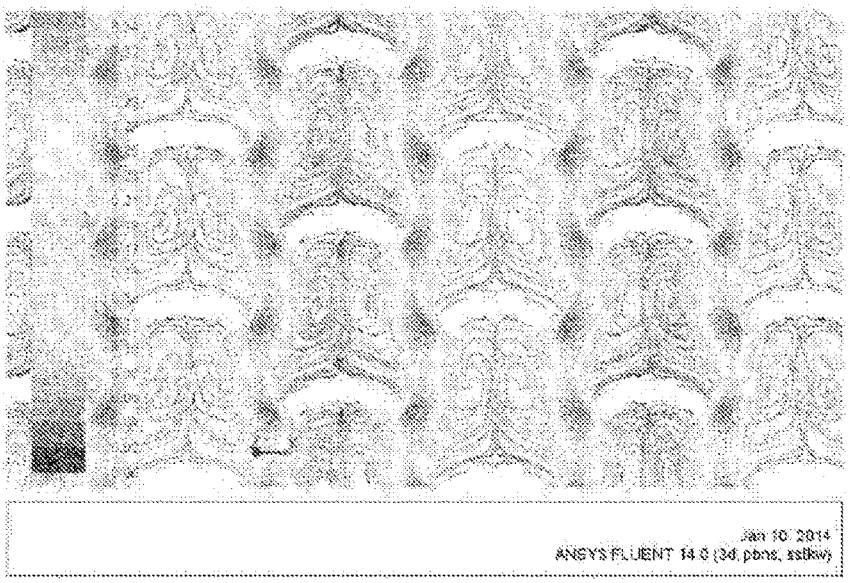
FIG. 12 is a computer simulation result, and shows a mode of heat exchange fluid flow in channels between multiple heat exchange plates according to an embodiment of the present invention when the heat exchange fluid flows in the channels, wherein the heat exchange fluid flows past the heat exchange plates in a longitudinal direction, and forms vortices in the recesses.

FIG. 12 shows in a simulated manner a mode of fluid flow in channels when the heat exchange fluid flows through a plate-type heat exchanger according to an embodiment of the present invention, wherein the heat exchange fluid flows past the heat exchange plates in a longitudinal direction. It can be understood that the heat exchange fluid may also flow past the heat exchange plates in a transverse or oblique direction. When the heat exchange fluid flows in a longitudinal direction through channels between multiple heat exchange plates according to an embodiment of the present invention, vortices are formed in regions below the elongated protrusions 13, i.e. in the recesses 12. It can be seen therefrom that in the heat exchange plate according to an embodiment of the present invention, by providing an elongated protrusion structure and setting the range of the apex angle α of the triangle formed by three recesses 12 or protrusions 13 which are adjacent in the transverse direction T to be 50° to 160°, stronger heat exchange fluid vortices can be generated, so that the heat exchange efficiency can be increased, while the elongated protrusion structure ensures joining strength during installation, i.e. ensures the strength of the plate-type heat exchanger overall.

Although the present invention has been described in conjunction with various embodiments, it can be understood from the description that components and structures herein could be combined, altered and improved in various ways, with such combinations, alterations and improvements falling within the scope of the present invention.

What is claimed is:

1. A heat exchange plate, comprising a plate main body, with multiple recesses and protrusions being disposed on a surface of the plate main body, wherein the multiple recesses and protrusions are arranged alternately in a first direction and also arranged alternately in a second direction perpendicular to the first direction, and the tops of the multiple protrusions have an elongated shape in the first direction;

wherein each protrusion has a first edge and a second edge, the first edge and the second edge being in the shape of a curved line;

wherein each protrusion has a third edge and a fourth edge, the angular range of an included angle between the third edge and the fourth edge is 0° to 180°;

wherein the angular range of the included angle is 20° to 110°; and wherein both the first edge and the second edge are arcuate, and the curvature of the first edge is greater than the curvature of the second edge.

2. The heat exchange plate as claimed in claim 1, wherein a protrusion and a recess which are adjacent to one another are connected in a transitional manner by means of an inclined surface therebetween, while adjacent recesses are connected in a transitional manner by means of a curved surface trough therebetween, the bottom of the curved surface trough being higher than the bottom of the recess.

3. The heat exchange plate as claimed in claim 1, wherein an apex angle of a triangle formed by three recesses or protrusions which are adjacent in the direction of elongation of the protrusions is in the range 50° to 160°.

4. The heat exchange plate as claimed in claim 3, wherein the apex angle is in the range 70° to 150°.

5. The heat exchange plate as claimed in claim 1, wherein the shape of the top of the protrusions is 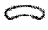 .

6. The heat exchange plate as claimed in claim 5, wherein the bottoms of the multiple recesses have a round shape or a polygonal shape.

7. The heat exchange plate as claimed in claim 1, wherein the first direction makes an acute angle with a longitudinal direction, makes an obtuse angle with the longitudinal direction, is parallel to the longitudinal direction or is perpendicular to the longitudinal direction.

8. The heat exchange plate as claimed in claim 1, wherein the heat exchange plate comprises at least two heat exchange plate units, wherein the orientation of the first directions in any two adjacent exchange plate units forms an inverted-V shape.

9. A plate-type heat exchanger, comprising multiple heat exchange plates as claimed in any one of the preceding claims, joined together in an overlapping state, with channels for the flow of heat exchange fluid being formed in spaces between the plates.

10. The plate-type heat exchanger as claimed in claim 9, wherein the multiple heat exchange plates are joined together by brazing, semi-welding or full welding.

11. The plate-type heat exchanger as claimed in claim 9, wherein the multiple heat exchange plates are joined together in a dismantlable manner.

12. The heat exchange plate as claimed in claim 2, wherein an apex angle of a triangle formed by three recesses or protrusions which are adjacent in the direction of elongation of the protrusions is in the range 50° to 160°.

* * * * *